US006279175B1

(12) United States Patent
Blaney

(10) Patent No.: US 6,279,175 B1
(45) **Date of Patent: *Aug. 28, 2001**

(54) OVERFLOW PREVENTER

(75) Inventor: Trevor Blaney, London (GB)

(73) Assignee: Liforma Investments NV (MC)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/669,323

(22) PCT Filed: Jan. 4, 1995

(86) PCT No.: PCT/GB95/00007

§ 371 Date: Aug. 28, 1997

§ 102(e) Date: Aug. 28, 1997

(87) PCT Pub. No.: WO98/18896

PCT Pub. Date: Jul. 13, 1995

(30) Foreign Application Priority Data

Jan. 4, 1994 (GB) ..... 9400005
Jul. 1, 1994 (GB) ..... 9413224

(51) Int. Cl.[7] ..... E03C 1/23

(52) U.S. Cl. ..... 4/287; 4/295; 137/542

(58) Field of Search ..... 4/287, 293, 295, 4/390, 651, 653, 680, 688; 137/542

(56) References Cited

U.S. PATENT DOCUMENTS

| | | | | |
|---|---|---|---|---|
| 300,552 | * | 6/1884 | Bacon | 4/287 |
| 306,385 | * | 10/1884 | Crosby | 137/542 X |
| 645,749 | * | 3/1900 | Kasschu | 4/287 |
| 957,012 | * | 5/1910 | Stone | 137/516.13 X |
| 1,581,533 | * | 4/1926 | Freer | 4/287 |
| 3,911,508 | * | 10/1975 | Goldberg | 4/287 |
| 4,369,531 | * | 1/1983 | Swanson | 4/295 |
| 5,343,572 | * | 9/1994 | Ament | 4/390 X |

FOREIGN PATENT DOCUMENTS

| | | |
|---|---|---|
| 2 285 216 | 7/1995 | (GB) . |
| 2 290 467 | 1/1996 | (GB) . |

* cited by examiner

*Primary Examiner*—Robert M. Fetsuga
(74) *Attorney, Agent, or Firm*—Cantor Colburn LLP

(57) ABSTRACT

An overflow preventer comprising a plug receivable in a drain hole and provided with a valve movable between a first closed position and a second open position, the valve being resiliently biased to the first position while the pressure on the valve is less than a predetermined value.

2 Claims, 3 Drawing Sheets

OVERFLOW PREVENTER

This invention relates to an overflow preventer primarily but not exclusively for baths and sinks.

Bath and sinks may be provided with overflows which direct excess water to a drain. The overflow may however not be able to cope with the flow of water and spillage may still occur.

GB 2 261 600 (Lewis) describes an overflow preventer in which passage of water through a conduit attached to the overflow causes the plug to be displaced from the overflow. The arrangement is very expensive to make and fit. Furthermore when the preventer is actuated its action is irreversible. This means that if a bath is filled rather full and a bather displaces water so that some passes through the overflow the device will be actuated and unless reset all the water will drain from the bath leaving the bather high and dry.

According to some embodiments of the invention there is provided an overflow preventer comprising a plug receivable in a drain hole and provided with a valve movable between a first closed position and a second open position, the valve being resiliently biased to the first position while the pressure on the valve is less than a predetermined value.

The valve may be resiliently biased for example by a spring such as a compression spring or a tension spring.

The valve may be a annular valve. A circumferential valve seat may be provided in the plug. The valve may be provided with an O-ring for sealing on the seat of the valve body. The plug may comprise resilient plastics material. The outer circumference may be provided with an O-ring to engage sealingly with the plug hole.

Embodiments of the invention will be illustrated by way of example only by reference to the accompanying figures of which:

Figure 1:
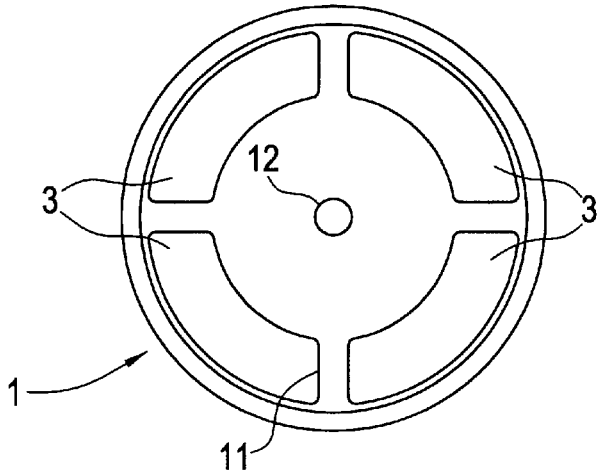
FIG. 1 is a top plan of an embodiment of the invention.
Figure 2:
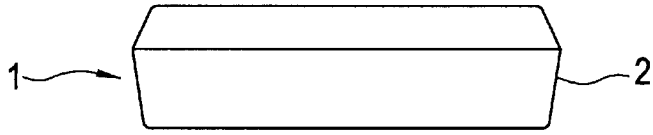
FIG. 2 is a side view of the plug body of the embodiment of FIG. 1.
Figure 3:
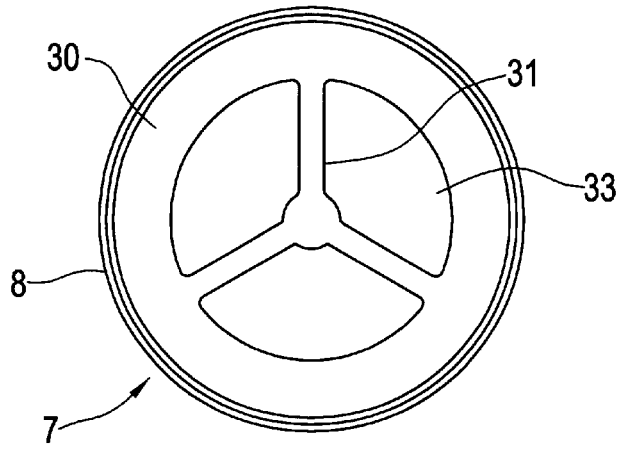
FIG. 3 is a plan of a valve of the embodiment of FIG. 1.
Figure 4:
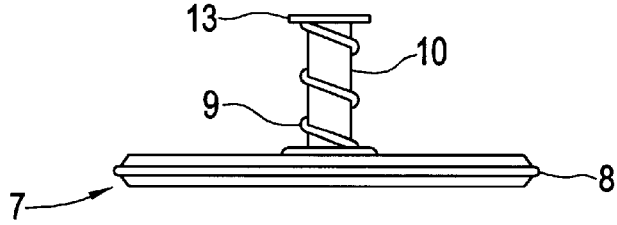
FIG. 4 is a side elevation of the valve of FIG. 1.
Figure 5:
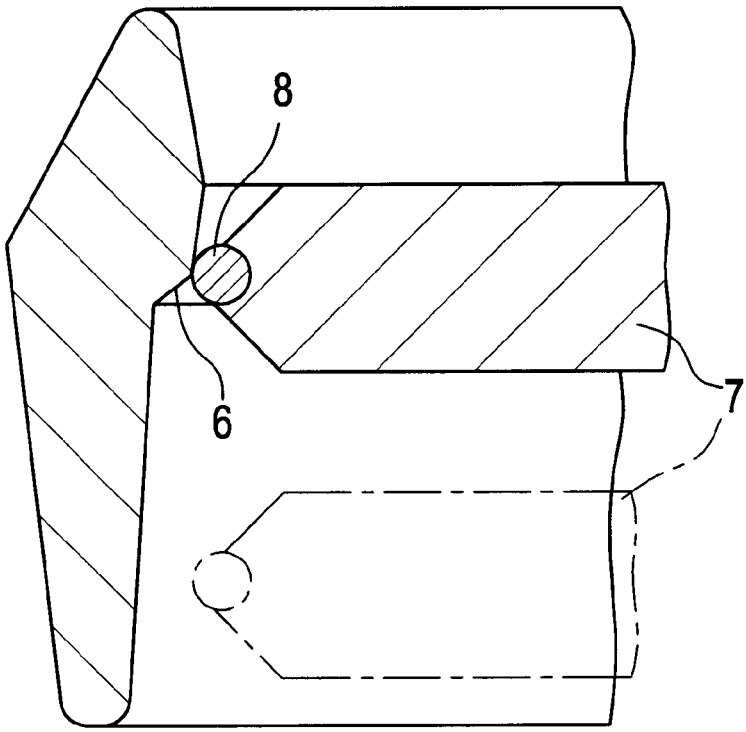
FIG. 5 is an enlarged scrap cross-sectional view of the preventer of the first embodiment.

The embodiment of FIGS. 1 to 5 is intended as a replacement for a bath or sink plug. In general a cord or chain or other fastener (not shown) secures the device to the bath or sink in each illustrated embodiment. This is not essential and by way of example the preventer may be fitted to an auxiliary drain and thus a separate plug and plug hole could still be required. The preventer may additionally be fitted to conventional overflows. This could have the advantage of preventing spiders crawling through the overflow and into the bath to the possible horror or in some cases danger of the user. In Australia and some other parts of the world conventional overflows are not fitted because of the danger of venomous spiders living in the overflow. Since the preventor of the invention is closed in the rest position any spider living in the overflow is unlikely to be able to escape into the bath of a user. The embodiment therefore has a body (1) for reception in or over the plug hole. Conveniently the body comprises a plastics material. Preferably the plastics has a degree of resilience to assist in forming a watertight fit to the plug hole. Fitting may also be facilitated by providing a tapered portion (2) on the body. Preferably the taper is in the range 5 to 10° preferably 7 to 9° especially about 8°. This may also allow a preventer to be fitted to a range of different sizes of plug hole. It may be desirable to provide an first O-ring 8*a* received in a peripheral groove of the body (1) to provide even better sealing. As can be seen from FIG. 1 conduits (first openings) (3) are provided in the body which communicate with the valve to be described hereinafter. In the illustrated embodiment the conduits are on the top face of the body but they could be provided on the side although a less compact device might result. Preferably the conduit's area is about 20% or 25% to 60% more preferably 30 to 50% of the area of the top face area of the preventer. If the area is too low then drainage may prove too slow and also BSI (British Standard Institute) recommendations may not be complied with. If much greater than about 60% the top face may be too weak. The precise area is not however of the essence of the invention.

A lip (6) is provided in the body and as described hereinafter this acts as a valve seat in the illustrated embodiment.

A valve (7) is provided. In the embodiment described it comprises a disc preferably of plastics material especially resilient plastics material. A second O-ring (8) may be provided in the circumference to form a good seal with the seat (6). Where the valve is of or coated with resilient material a good seal may be obtained without an O-ring. Alternatively or additionally an O-ring may be provided on the seat in the rest position the valve (7) is biased against the valve seat (6) to form a seal. When the bath is filled with water the pressure on the valve increases. If filling is continued the pressure on the valve (7) will overcome the bias and urge the valve (7) off the valve seat (6). The valve will then move for example to the position shown in ghosted lines in FIG. 5. The conduit (3) will then be open and excess water will run away to waste. When supply of water to the bath stops water will drain away until the pressure of water no longer overcomes the bias. The bias will then urge the valve (7) back to the seat (6) and prevent further flow. The valve member (7) of this embodiment is broadly wheel-shaped having an outer rim (30) connected to the valve rod (10) by three peripheral spokes (31). The valve member 7 accordingly includes second openings (33) which are formed in valve member 7 and are defined by outer rim (30), valve rod (10), and peripheral spokes (31). When the valve is in the no load position the peripheral area is sealed by the rim engaging the lip. The valve rod guide (12) overlies the gaps in the valve (7) defined by the ring (30) and spokes (31) preventing escape of water in the no load position. When actuated water escapes not only around the rim by also through the gaps defined by the rim and spokes. This allows a high volume of water to pass through the valve when actuated.

The preferred bias is a spring (9) but this is not essential for the performance of the invention. In the illustrated embodiments the valve depends from a valve rod (10). In the preferred embodiment the valve rod (10) is received in a valve rod guide (12) which in combination with legs (11) of the body (1) define conduit openings (3).

A spring (9) is received over the valve rod and held in position for example by a clip (13). Spring production is now a well understood art and the production of springs of the desired strength is relatively straightforward. It may not therefore be necessary to provide an adjuster to adjust the force produced by the spring. The valve is preferably a pop valve which stays closed until the pressure exceeds an operating valve and then opens widely. By appropriate spring selection this should be readily achievable.

An embodiment of FIGS. 1 to 5 was subject to a test which the drain hole of a bath was 0.685 m above an open discharge. The temperature was 20° C. The device was seemed into the drain hole. The conduit area of the body was 555.26 $mm^2$. The plan areas of the top of the body was about 3165 $mm^2$. As the base and valve separated an additional gap of 125.68 $mm^2$ per mm drop was created. A spring opening at 0.023 m (9") was selected and the rate of water flowing into the bath adjusted until a steady strike was achieved. This was found to be $4.17\times10^{-4}$ $m^3s^{-1}$ (5.5. UK gals/min).

The specific rate of discharge was therefore about 0.13 $ms^{-1}$. It is preferred that the specific rate of discharge under the above conditions be at least 0.1 $ms^{-1}$ preferably at least 0.125 $ms^{-1}$ still more preferably at least 0.175 $ms^{-1}$ and yet more preferably at least 0.2 $ms^{-1}$ even more preferably at least 0.25 $ms^{-1}$. The specific rate of discharge is important. If it is too low then a large device will be necessary to pass sufficient water. A high specific rate of discharge can be obtained by providing both the body and valve with holes which are closed when the valve is in the rest position and open when the valve is activated. This can be achieved by overlying solid portions of the body over conduit portions of the valve and vice versa.

It is preferred that the open area increase as the valve moves further away from its rest position since the efficiency will then increase with rate of discharge.

In the event that water passes through a conventional overflow to discharge a primitive pump or suction action may still further increase the devices efficiency.

If desired a cover (not shown) may be provided over the valve rod and spring.

Modifications to the invention will be apparent to workers skilled in the art. For example in the second illustrated embodiment a plurality of cylindrical holes (14) are formed in the body (1). The face of the valve (7) has a resilient coating (15) for example of rubber to improve sealing with the valve seat. When the water pressure on the valve (7) exceeds the biasing force of the spring (9) the excess water escapes around the edge of the valve and through channels (16) where provided. The biasing force provided by the spring can be adjusted by moving a nut (17) bearing on a washer (19) on the threaded portion of the valve rod (10). A cover (18) is provided on the body (1) over the valve rod and spring.

Figure 9:
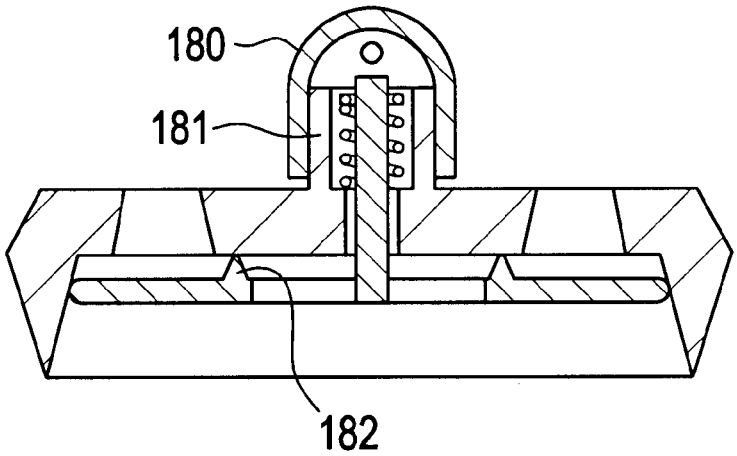
FIG. 9 is a cross-section of a further embodiment.
Figure 6:
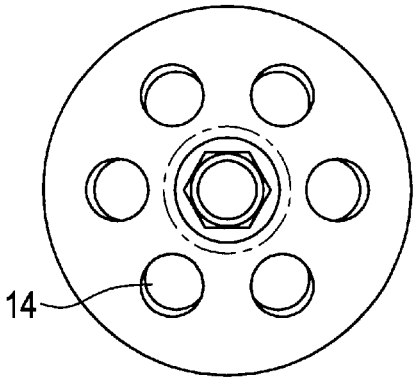
FIG. 6 is a top plan of a second embodiment.
Figure 7:
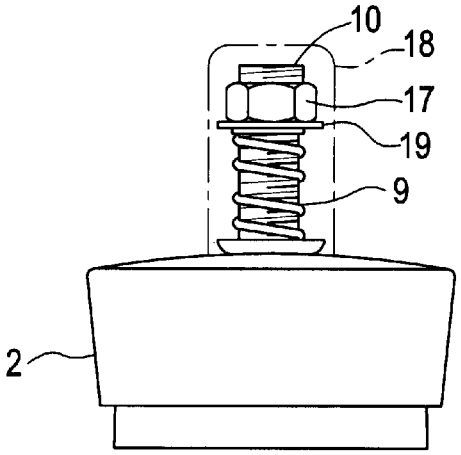
FIG. 7 is a side elevation of the second embodiment.
Figure 8:
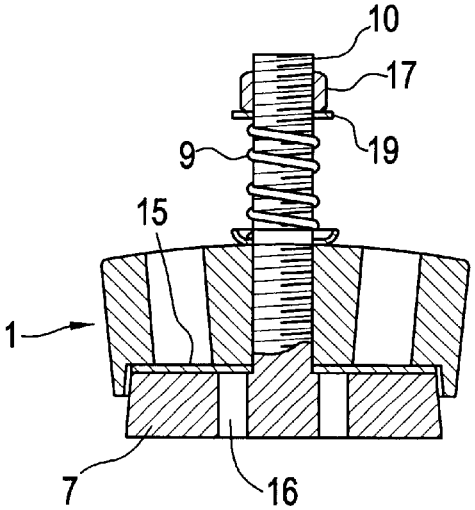
FIG. 8 is a cross sectional view of the second embodiment.

In the third embodiment of the invention illustrated in FIG. 9 the device is provided with cover (180). Cover (180) is provided with a coating of thermal changing material. For example a liquid crystal material changing to red at a temperature of about 50° C. may be provided. Where present the thermal colour changing material provides a warning of excessive water temperature. If the cover (180) is transparent or translucent the colour changing material can be present on the inside of the cover and thus be relatively resistant to wear.

The cover (180) can be an interference fit on a preferably cylindrical upstand (181) provided on the body. If this is done the cover (180) may be of resilient material which can be slipped over the upstand. A fixing chain or cord carried on the cover may be provided to secure the device to the bath or sink.

In some embodiments of the invention as for example that shown in FIG. 9 a seal is provided on the face of the valve abutting the body. The seal can comprise a raised circular resilient member (182) formed in either or both the valve or the body. This seal serves to reduce leakage.

It may be desirable to provide a draft angle on the cavities of valve or body. This serves to facilitate moulding if the device is made of plastics and may also increase throughput.

Although the invention has been discussed by reference to baths it will be apparent that it has utility elsewhere notably in basins and cisterns. The skilled will have no difficulty in altering the biasing force to provide the desired maximum depth before the preventer actuates.

What is claimed is:

1. An overflow preventer removably receivable in a plug hole of a bath or sink, said overflow preventer comprising:

a plug body removably receivable in said plug hole, the plug body having first openings formed therein; and a valve having second openings formed therein, the valve being movable between a first, closed position where said plug body overlies said second openings of the valve so as to prevent fluid communication between the first and second openings, and a second, open position, where said first and second openings fluidly communicate and define a conduit through which water can flow to waste, said valve being biased to the first position by resilient biasing means while hydrostatic pressure on said valve is less than a predetermined value, at least one of said valve and said body comprising a resilient material, wherein said valve comprises an annular valve having a circumference, said circumference having an O-ring for sealing a valve seat of said plug body.

2. An overflow preventer removably receivable in a plug hole of a bath or sink, said overflow preventer comprising:

a plug body removably receivable in said plug hole, the plug body having first openings formed therein, said plug body including a lip for providing a valve seat; and a valve having second openings formed therein, the valve being movable between a first, closed position where said plug body overlies said second openings of the valve so as to prevent fluid communication between the first and second openings, and a second, open position, where said first and second openings fluidly communicate and define a conduit through which water can flow to waste, said valve being biased to the first position by resilient biasing means while hydrostatic pressure on said valve is less than a predetermined value, wherein said valve includes an O-ring extending around a peripheral edge thereof, said O-ring providing a seal with said lip of plug body in said first, closed position.

* * * * *

UNITED STATES PATENT AND TRADEMARK OFFICE

CERTIFICATE OF CORRECTION

PATENT NO. : 6,279,175 B1
DATED : August 28, 2001
INVENTOR(S) : Trevor Blaney

It is certified that error appears in the above-identified patent and that said Letters Patent is hereby corrected as shown below:

Column 2,
Line 47, after "defined by the" delete "ring" and insert therefor -- rim --

Signed and Sealed this

Tenth Day of May, 2005

JON W. DUDAS
*Director of the United States Patent and Trademark Office*